US008526629B2

(12) United States Patent
Li et al.

(10) Patent No.: US 8,526,629 B2
(45) Date of Patent: Sep. 3, 2013

(54) AUDIO OUTPUT APPARATUS AND COMPENSATION METHOD THEREOF

(75) Inventors: Horng-Pang Li, Taipei (TW); Chao-Yu Chen, Taipei (TW)

(73) Assignee: ALi Corporation, Taipei (TW)

( * ) Notice: Subject to any disclaimer, the term of this patent is extended or adjusted under 35 U.S.C. 154(b) by 339 days.

(21) Appl. No.: 12/913,012

(22) Filed: Oct. 27, 2010

(65) Prior Publication Data

US 2011/0103599 A1 May 5, 2011

(30) Foreign Application Priority Data

Oct. 30, 2009 (CN) ..... 2009 1 0209423

(51) Int. Cl.
*H04R 1/10* (2006.01)

(52) U.S. Cl.
USPC ..... 381/74

(58) Field of Classification Search
USPC ..... 381/74
See application file for complete search history.

(56) References Cited

U.S. PATENT DOCUMENTS

| | | | | |
|---|---|---|---|---|
| 7,065,219 | B1 * | 6/2006 | Abe et al. | 381/74 |
| 2002/0012435 | A1 * | 1/2002 | Colegrave et al. | 381/74 |
| 2003/0076973 | A1 * | 4/2003 | Yamada | 381/309 |
| 2006/0182287 | A1 | 8/2006 | Schulein et al. | |
| 2007/0133809 | A1 | 6/2007 | Felder | |

* cited by examiner

*Primary Examiner* — Alexander Jamal
(74) *Attorney, Agent, or Firm* — J.C. Patents

(57) ABSTRACT

An audio output apparatus including a digital operation unit, a digital-to-analog converter (DAC), a left channel unit, a right channel unit and a common unit is provided. During an initial setting, the digital operation unit detects a cross talk voltage on a left channel earphone unit in the left channel unit or a right channel earphone unit in the right channel unit, calculates a first ratio and a second ratio, and then performs an arithmetic operation on a left and a right channel signals according to the first and the second ratios, so as to obtain a compensated left channel signal and a compensated right channel signal respectively for eliminating a cross talk phenomenon.

12 Claims, 8 Drawing Sheets

AUDIO OUTPUT APPARATUS AND COMPENSATION METHOD THEREOF

CROSS-REFERENCE TO RELATED APPLICATION

This application claims the priority benefit of China application serial no. 200910209423.3, filed on Oct. 30, 2009. The entirety of the above-mentioned patent application is hereby incorporated by reference herein and made a part of this specification.

BACKGROUND OF THE INVENTION

1. Field of the Invention

The present invention relates to an audio output apparatus. Specifically, the present invention relates to an audio output apparatus capable of compensating a cross talk phenomenon.

2. Description of Related Art

With a popularization of consumer electronic products, functions and exquisiteness of peripheral products applied to the consumer electronic products are strengthened. Accordingly, taking an earphone for an audio output apparatus as an example, shapes, functions and qualities of the earphones are greatly improved currently. Moreover, the demands of low electromagnetic interference (EMI) and low noise have to be taken into consideration for providing a high quality sound broadcasting effect of the earphones.

There are two types of the conventional audio output apparatus. One type is a cap mode audio output apparatus, and the other type is a capless mode audio output apparatus. Generally, if there is a capacitor serially coupled to a channel for transmitting left and right channel signals from left and right channel amplifying modules to left and right channel earphones in the audio output apparatus, this kind of audio output apparatus is referred to as the cap mode audio output apparatus. Comparatively, if there is not the capacitor serially coupled to the channel for transmitting left and right channel signals from left and right channel amplifying modules to left and right channel earphones in the audio output apparatus, this kind of audio output apparatus is referred to as the capless mode audio output apparatus.

Regardless of the cap mode or the capless mode audio output apparatus, for providing a frequency modulation (FM) antenna impedance matching and reducing the EMI phenomenon, beads are connected to paths of the left and the right channel earphones receiving the left and the right channel signals and common connection node of the left and the right channel earphones, respectively. The so-called bead is substantially equivalent to a small inductor, which can provide a filtering function. The bead provide an impedance matching of a high frequency (around 100 MHz) in FM application, though it still has a slightly impedance in case of a low frequency. Besides the above beads, the left and the right channel earphones also provide low frequency equivalent impedances when low frequency signals pass there through. Due to the low frequency equivalent impedances and a connection method in internal of the audio output apparatus, a so-called cross talk phenomenon is generated on the left and the right channel earphones, so that a sound quality is reduced.

To solve the cross talk phenomenon, a U.S. Patent No. US2007/0133809 discloses an audio output apparatus. FIG. 1 illustrates a schematic diagram of a conventional audio output apparatus 100 for suppressing the cross talk phenomenon. The audio output apparatus 100 includes a digital-to-analog converter (DAC) 110 used for receiving a left and a right channel signal DATA, amplifiers AMPL, AMPR and AMPC, a reference voltage generating module 120, a feedback circuit 130, beads B1-B3, and earphone units HPL and HPR. The feedback circuit 130 of the audio output apparatus 100 captures a cross talk voltage generated due to the cross talk phenomenon from a feedback point FBP, and transmits the cross talk voltage to a negative input terminal of the amplifier AMPC. Then, the amplifier AMPC transmits an inverted cross talk voltage to the feedback point FBP to counteract the cross talk voltage.

SUMMARY OF THE INVENTION

The present invention is directed to an audio output apparatus for eliminating a cross talk phenomenon interactively generated between a left channel and a right channel interactively.

The present invention is directed to a method for compensating an audio output apparatus, by which a cross talk phenomenon interactively generated between a left channel and a right channel of the audio output apparatus can be eliminated.

The present invention provides an audio output apparatus including a digital operation unit, a digital-to-analog converter (DAC), a left channel unit, a right channel unit and a common unit. The digital operation unit receives a left channel signal and a right channel signal, and performs an arithmetic operation to obtain a compensated left channel signal and a compensated right channel signal, respectively. The DAC is coupled to the digital operation unit. The DAC receives and converts the compensated left channel signal and the compensated right channel signal to output a left channel analog signal and a right channel analog signal. The left channel unit is coupled to the DAC and the digital operation unit. The left channel unit having a left channel amplifying module, a left channel bead and a left channel earphone unit. The right channel unit is coupled to the DAC and the digital operation unit. The right channel unit having a right channel amplifying module, a right channel bead and a right channel earphone unit. The common unit having a common bead is coupled to the left channel unit and the right channel unit. The digital operation unit performs the arithmetic operation on the left channel signal and the right channel signal according to a first ratio and a second ratio, so as to obtain the compensated left channel signal and the compensated right channel signal respectively. The first ratio is generated according to impedance values of low-frequency equivalent impedances of the left channel earphone unit, the left channel bead and the common bead. The second ratio is generated according to impedance values of low-frequency equivalent impedances of the right channel earphone unit, the right channel bead and the common bead.

In an embodiment of the present invention, the first ratio is greater than 0 and less than twice of a first predetermined value. The first predetermined value is equal to the impedance value of the low-frequency equivalent impedance of the common bead divided by a sum of the impedance values of the low-frequency equivalent impedances of the left channel earphone unit, the left channel bead and the common bead.

In an embodiment of the present invention, the second ratio is greater than 0 and less than twice of a second predetermined value. The second predetermined value is equal to the impedance value of the low-frequency equivalent impedance of the common bead respectively divided by a sum of the impedance values of the low-frequency equivalent impedances of the right channel earphone unit, the right channel bead and the common bead.

In an embodiment of the present invention, the audio output apparatus further includes a reference voltage generation module and a common unit amplifying module. The reference voltage generation module is coupled to the DAC and is used for providing a reference voltage. The common unit amplifying module is coupled to the reference voltage generation module and is used for generating a common voltage according to the reference voltage. The common unit transmits the common voltage to the left channel earphone unit and the right channel earphone unit.

In an embodiment of the present invention, the digital operation unit includes an analog-to-digital converter (ADC) circuit and a digital signal operation circuit. The ADC circuit is coupled to a connection point of the left channel earphone unit and the right channel earphone unit and is used to receive a cross talk voltage to obtain a peak value of the cross talk voltage. The digital signal operation circuit is coupled to the ADC circuit, and generates the first and the second ratios according to the peak value of the cross talk voltage. The digital signal operation circuit performs the arithmetic operation to the left channel signal and the right channel signal according to the first and the second ratios, so as to obtain the compensated left channel signal and the compensated right channel signal, respectively.

In an embodiment of the present invention, the digital operation unit further generates a reduced ratio. The digital operation unit performs the arithmetic operation on the left channel signal and the right channel signal according to the reduced ratio and the first and the second ratios, so as to obtain a reduced compensated left channel signal and a reduced compensated right channel signal, respectively.

In an embodiment of the present invention, the impedance value of the low-frequency equivalent impedances of the left channel earphone unit and the impedance value of the low-frequency equivalent impedances of the right channel earphone unit are equivalent. The impedance value of the low-frequency equivalent impedances of the left channel bead, the impedance value of the low-frequency equivalent impedances of the right channel bead and the impedance value of the low-frequency equivalent impedances of the common bead are equivalent.

The present invention provides a method for compensating an audio output apparatus, which is used to compensate a cross talk phenomenon generated in the audio output apparatus. The steps of the method includes: firstly, a first and a second ratios are received. The first ratio is generated according to impedance values of low-frequency equivalent impedances of a left channel earphone unit, a left channel bead and a common bead, and the second ratio is generated according to impedance values of low-frequency equivalent impedances of a right channel earphone unit, a right channel bead and the common bead. Secondly, a left channel signal and a right channel signal are received. Finally, a digital operation unit is provided to perform an arithmetic operation on the left channel signal and the right channel signal according to the first and the second ratios, so as to obtain a compensated left channel signal and a compensated right channel signal respectively.

According to the above descriptions, in the present invention, the low-frequency equivalent impedances of the left and the right channel earphone units in the audio output apparatus are obtained, and the low-frequency equivalent impedances of the left and the right channel beads and the common bead connected to the left and the right channel earphone units are obtained. Then, the first and the second ratios are calculated according to the low-frequency equivalent impedances of the left and the right channel earphone units, the left and the right channel beads and the common bead. Moreover, the arithmetic operation is performed on the left channel signal and the right channel signal received by the audio output apparatus according to the first and the second ratios, so as to obtain the compensated left channel signal and the compensated right channel signal, respectively. By such means, the cross talk phenomenon generated in the audio output apparatus is effectively eliminated.

In order to make the aforementioned and other features and advantages of the present invention comprehensible, several exemplary embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
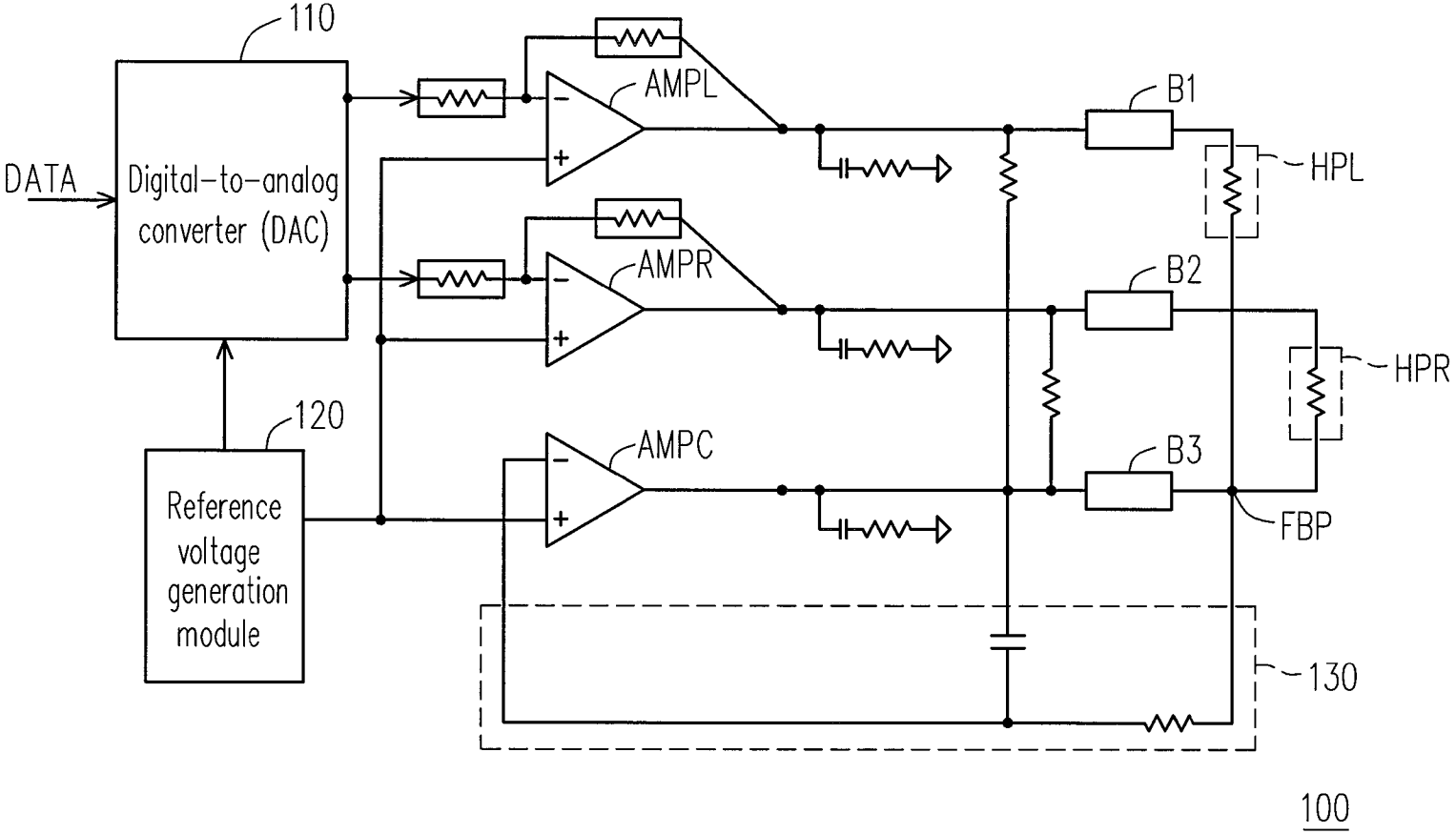
FIG. 1 (PRIOR ART)
FIG. 1 illustrates a schematic diagram of a conventional audio output apparatus capable of mitigating a cross talk phenomenon.
Figure 2A:
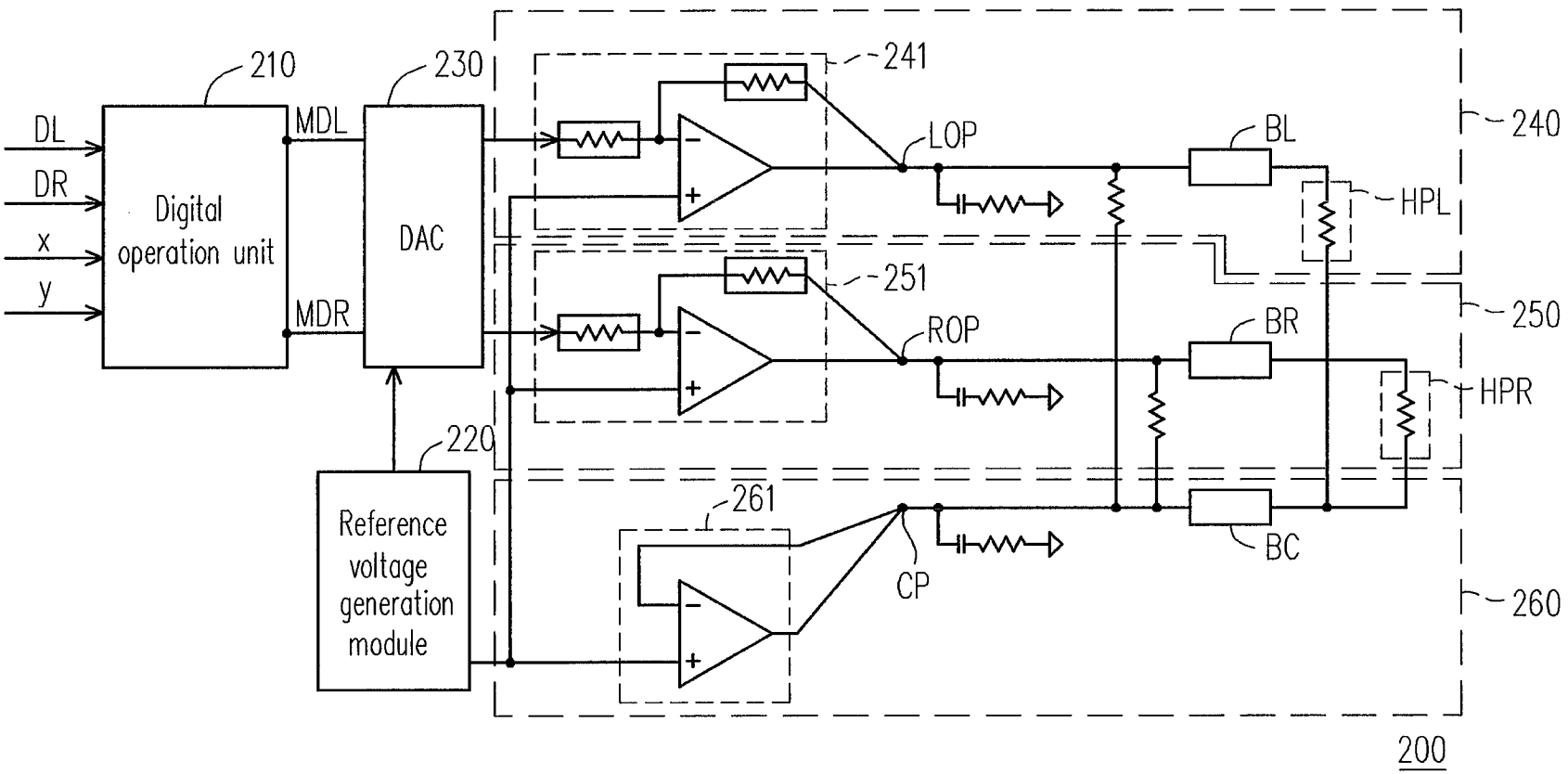
FIG. 2A is a schematic diagram illustrating a capless mode audio output apparatus according to an embodiment of the present invention.

Referring to FIG. 2A, FIG. 2A is a schematic diagram illustrating an audio output apparatus with capless mode according to an embodiment of the present invention. The audio output apparatus 200 includes a digital operation unit 210, a reference voltage generation module 220, a digital-to-analog converter (DAC) 230, a left channel unit 240, a right channel unit 250 and a common unit 260.

The left channel unit 240 includes a left channel amplifying module 241, a left channel bead BL and a left channel earphone unit HPL connected in series. The right channel unit 250 includes a right channel amplifying module 251, a right channel bead BR and a right channel earphone unit HPR connected in series. The common unit 260 includes a common unit amplifying module 261 and a common bead BC connected in series. The common unit amplifying module 261 is used for providing a voltage potential. One ends of the left channel earphone unit HPL and the right channel earphone unit HPR are connected to a first end of the common bead BC, respectively.

The digital operation unit 210 receives a left channel signal DL, a right channel signal DR, a first ratio x and a second ratio y. The first ratio x and the second ratio y are generated according to a plurality of impedance values of low-frequency equivalent impedances of the left channel earphone unit HPL, the right channel earphone unit HPR, the left channel bead BL, the right channel bead BR, and the common bead BC. The digital operation unit 210 performs an arithmetic operation on the left channel signal DL and the right channel signal DR according to the first ratio x and the second ratio y, so as to obtain a compensated left channel signal MDL and a compensated right channel signal MDR respectively.

The DAC 230 receives the compensated left channel signal MDL and the compensated right channel signal MDR, and converts these digital signals from digital format to analog format.

The reference voltage generation module 220 generates a reference voltage to the DAC 230.

Figure 2B:
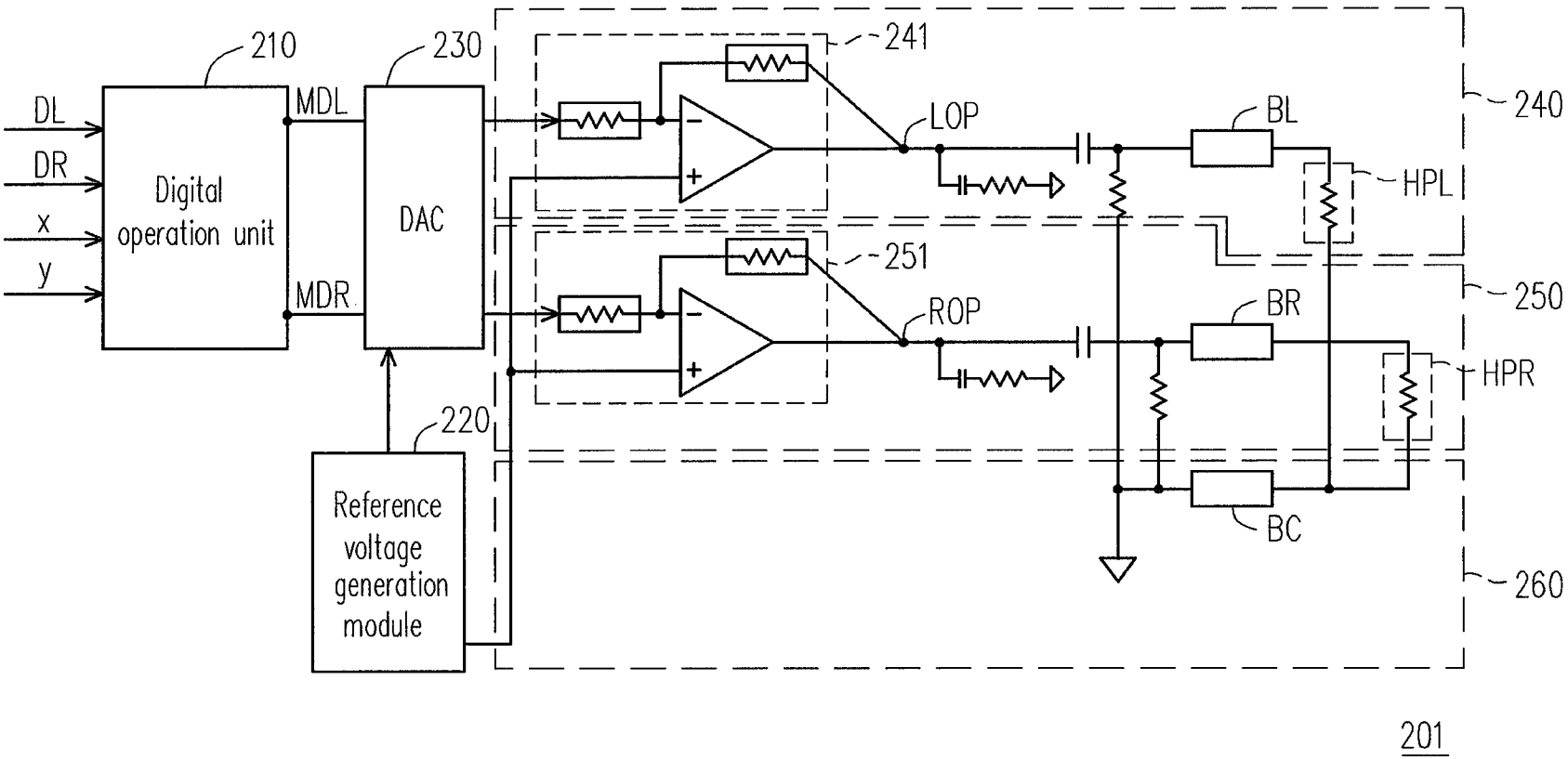
FIG. 2B is a schematic diagram illustrating a cap mode audio output apparatus according to an embodiment of the present invention.

Referring to FIG. 2B. FIG. 2B is a schematic diagram illustrating an audio output apparatus with cap mode according to an embodiment of the present invention. The method of compensating the cross talk phenomenon by using the first and the second ratios can be applied to the audio output apparatus with capless mode 200 of FIG. 2A, and also can be applied to the audio output apparatus with cap mode 201 of FIG. 2B. Operation of the audio output apparatus with cap mode 201 is similar as the operation of the audio output apparatus with capless mode 200, and therefore detailed description is not repeated thereof. It should be noticed that in the cap mode of the audio output apparatus 201, one end of the common bead BC is coupled to the ground end, and another end thereof is coupled to one ends of the left channel earphone unit HPL and the right channel earphone unit HPR, respectively. The common unit 260 does not have an amplifying module since the ground provides a voltage potential.

In the present invention, the ratios are generated in advance according to the low-frequency equivalent impedances of the left and the right earphone units and various beads to compensate the left and the right channel signals, so as to eliminate the cross talk phenomenon generated by the low-frequency equivalent impedances of the left and the right earphone units of the audio output apparatus.

Figure 3:
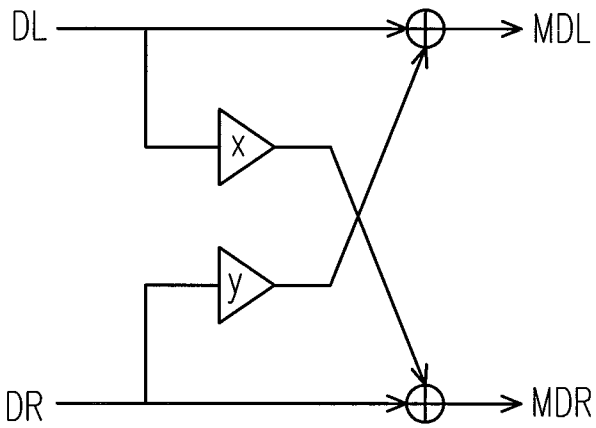
FIG. 3 is a schematic diagram illustrating a compensation calculation structure of an audio output apparatus according to an embodiment of the present invention.

A calculation method of the first ratio and the second ratio is described below with reference of FIG. 2A and FIG. 3. FIG. 3 is a schematic diagram illustrating a calculation structure for the audio output apparatus 200 compensating the left channel signal DL and the right channel signal DR according to an embodiment of the present invention. According to the compensation calculation, the compensated left channel signal MDL is equal to the left channel signal DL added up a product of the right channel signal DR and the second ratio y, and the compensated right channel signal MDR is equal to the right channel signal DR plus a product of the left channel signal DL and the first ratio x.

Figure 4B:
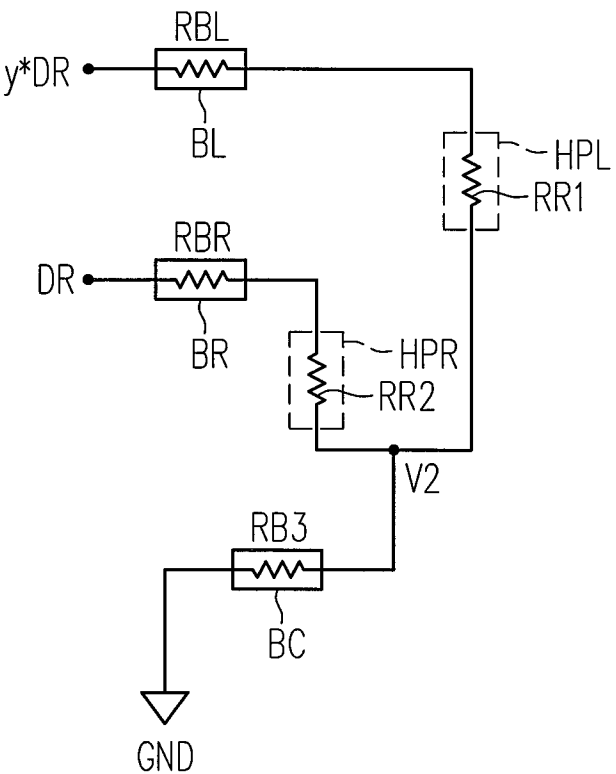
FIG. 4A and FIG. 4B are equivalent circuit diagrams obtained when compensated left and right channel signals are inputted to a audio output apparatus, respectively.
Figure 4A:
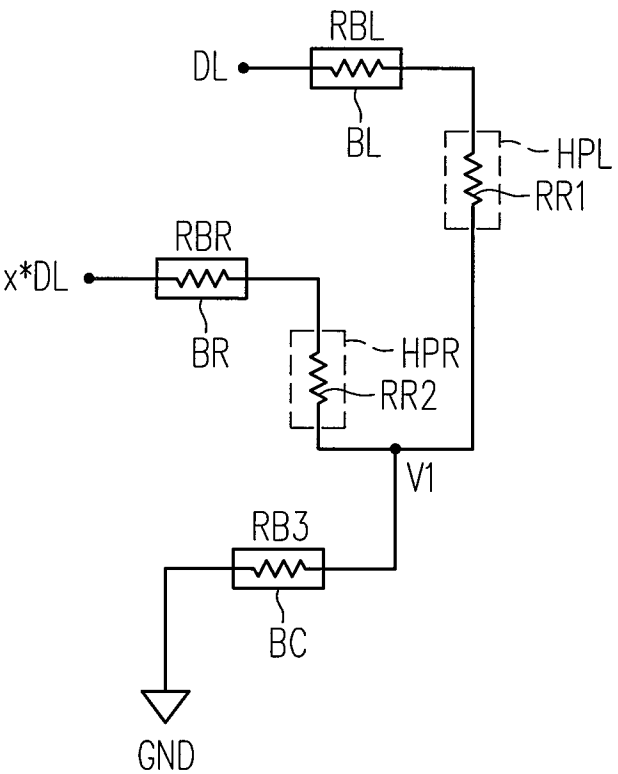

Then, referring to FIG. 4A and FIG. 4B, FIG. 4A and FIG. 4B are equivalent circuit diagrams when the compensated left and right channel signals are respectively inputted to the left and the right channels of the audio output apparatus 200. In FIG. 4A, the right channel signal DR is assumed to be zero (0), a resistance of the low-frequency equivalent resistor of the left channel bead BL is RBL, a resistance of the low-frequency equivalent resistor of the right channel bead BR is RBR, a resistance of the low-frequency equivalent resistor of the common bead BC is RB3, and resistances of the low-frequency equivalent resistors of the left channel earphone unit HPL and the right channel earphone unit HPR are RR1 and RR2, respectively. Under a condition that the voltage potential of the ground GND is zero (0) volt (V), from a relationship among a common connection point of the left channel earphone unit HPL and the right channel earphone unit HPR, and the left channel signal DL, a voltage V1 can be described as a following equation (1):

$$V1 = \frac{DL[(RR2 + RBR)\|RB3]}{(RR1 + RBL) + [(RR2 + RBR)\|RB3)]} + \frac{xDL[(RR1 + RBL)\|RB3]}{(RR2 + RBR) + [(RR1 + RBL)\|RB3]} \quad (1)$$

It should be noticed that in FIG. 4A, to ensure that the cross talk phenomenon does not influence an output of the right channel earphone unit HPR, a current flowing through the right channel earphone unit HPR is required to be 0. Namely, if the voltage V1 is equal to the first ratio x multiplied by the left channel signal DL, the cross talk phenomenon is eliminated. When such condition is applied to the above equation (1), the first ratio x is then obtained as that shown in a following equation (2):

$$x = \frac{RB3}{(RR1 + RBL + RB3)} \quad (2)$$

Similar to the description of FIG. 4A, in FIG. 4B, the left channel signal DL is assumed to be 0. At this time, a resistance of the low-frequency equivalent resistor of the right channel bead BR is RBR and a resistance of the low-frequency equivalent resistor of the left channel bead BL is RBL. Moreover, resistances of the low-frequency equivalent resistors of the left channel earphone unit HPL and the right channel earphone unit HPR are RR1 and RR2, respectively. Under a condition that a voltage of the ground GND is 0V, from a relationship among the common connection point of the left channel earphone unit HPL, the right channel earphone unit HPR, and the right channel signal DR, a voltage V2 on can be described as a following equation (3):

$$V2 = \frac{DR[(RR1 + RBL)\|RB3]}{(RR2 + RBR) + [(RR1 + RBL)\|RB3)]} + \frac{yDL[(RR2 + RBR)\|RB3]}{(RR1 + RBL) + [(RR2 + RBR)\|RB3]} \quad (3)$$

Similarly, to ensure that the cross talk phenomenon does not influence an output of the left channel earphone unit HPL, a current flowing through the left channel earphone unit HPL is required to be 0. Namely, if the voltage V2 is equal to the second ratio y multiplied by the right channel signal DR, the cross talk phenomenon is eliminated. When such condition is applied to the above equation (3), the second ratio y is then obtained as that shown in a following equation (4):

$$y = \frac{RB3}{(RR2 + RBR + RB3)} \quad (4)$$

It should be noticed that, the resistances RR1 and RR2 of the low-frequency equivalent resistors of the left channel earphone unit HPL and the right channel earphone unit HPR are, for example, 16 Kohm~47 Kohm, and the resistances RBL, RBR and RB3 of the low-frequency equivalent resistors of the left and the right channel beads BL and BR and the common bead BC are, for example, 0.2 ohm~0.4 ohm.

Namely, the resistances RB3 and RBR in the equation (4) can be neglected because they are far less than the resistance RR2. That is, the right side of the equation (4) can be simplified to be RB3/RB2, and that of the equation (2) can be simplified to be RB3/RR1. If the resistance RR1 is equal to the resistance RR2, the simplified first and the second ratios are equal to (RB3/RR2).

According to the above calculations, if the first and the second ratios are not provided, the cross talk phenomenon cannot be eliminated, and since there is not any compensation signal, no divided voltage is generated to counteract the cross talk voltage (i.e. V1−0=V1). When the first and the second ratios are greater than 0 and less then or equal to (RB3/RR2) obtained by the above calculations, a divided voltage is generated after the compensation, which can opportunely counteract the cross talk voltage (i.e. V1−Vy=0, Vy=V1). Then, if the first and the second ratios are increased to 2*(RB3/RR2) from (RB3/RR2), a twice divided voltage is generated after the compensation. At this time, after the twice divided voltage counteracts the cross talk voltage, there is still a negative cross talk voltage left (i.e. V1−Vy'=−V1, Vy'=2V1), which is the same situation that the first and the second ratios are not provided and a result thereof is the same as if the first and the second ratios are not provided. Therefore, a selection range of the second ratio y is between 0 and 2*(RB3/RR2) (including the simplified or un-simplified second ratio y).

i.e. 0<y"<K*y', wherein y'=RB3/RR2 and K<2

In the above descriptions, though the simplified second ratio (which can also be represented by a second predetermined value) is taken as an example, those with ordinary skill in the art should understand that the un-simplified second ratio can also be used. Similarly, a selection range of the first ratio x is also between 0 and 2*(RB3/RR2) (including the simplified or un-simplified second ratio x, which can also be represented by a first predetermined value), and detailed descriptions thereof are not repeated.

Referring to FIG. 2A again, the audio output apparatus 200 further includes the left channel amplifying module 241, the right channel amplifying module 251, the common unit amplifying module 261 and the reference voltage generation module 220. The left channel amplifying module 241 is coupled to the digital operation unit 210 for receiving the compensated left channel signal MDL. The left channel amplifying module 241 amplifies the compensated left channel signal MDL, and transmits the amplified compensated left channel signal MDL to the left channel earphone unit HPL through an output terminal LOP of the left channel amplifying module 241 (which is referred to as a left channel output terminal LOP, hereinafter). Similarly, the right channel amplifying module 251 amplifies the compensated right channel signal MDR, and transmits the amplified compensated right channel signal MDR to the right channel earphone unit HPR through an output terminal ROP of the right channel amplifying module 251 (which is referred to as a right channel output terminal ROP, hereinafter).

Moreover, since the impedance values the of low-frequency equivalent impedances of the left and the right channel earphone units HPL and HPR used in the audio output apparatus 200 are generally the same (RR1=RR2), and the impedance values the of low-frequency equivalent impedances of the left channel bead BL, the right channel bead BR and the common bead BC are also the same (RBL=RBR=RB3), the second ratio y and the first ratio x can be represented by a following equation (5):

$$x = y = \frac{RB3}{(RR1 + 2 \times RB3)} \tag{5}$$

It should be noticed that the left channel amplifying module 241, the right channel amplifying module 251, and the common unit amplifying module 261 can all be constructed from one or a plurality of operation amplifiers (OPAMP) and resistors, and a constructing method of internal circuits of these amplifying modules are known by those with ordinary skill in the art, and therefore detailed descriptions thereof are not repeated.

The reference voltage generation module 220 is coupled to the DAC 230 and the left channel amplifying module 241, the right channel amplifying module 251, and the common unit amplifying module 261. The reference voltage generation module 220 is used to provide a reference voltage to the DAC 230, the left channel amplifying module 241, the right channel amplifying module 251, and the common unit amplifying module 261.

It should be noticed that in an actual hardware implementation, the compensated left and right channel signals MDL and MDR could be excessively large compared to the left and the right channel signals DL and DR, and exceed a hardware tolerance. Namely, in the digital system, taking a 8 bits transmission bandwidth as an example, the compensated left and right channel signals MDL and MDR could be greater than 255 due to the arithmetic operation, so that a so-called saturation phenomenon is generated. Therefore, in case of a limited hardware structure, the digital operation unit 210 can also receive a reduced ratio and multiplies the reduced ratio by the compensated left and right channel signals MDL and MDR to generate a reduced compensated left channel signal and a reduced compensated right channel signal, so as to avoid the saturation phenomenon. Certainly, the reduced ratio can also be firstly multiplied by the original left and right channel signals DL and DR for reduction, and then the reduced left and right channel signals DL and DR are used to do the compensation calculation, by which the reduced compensated left channel signal and the reduced compensated right channel signal can also be obtained.

Figure 5:
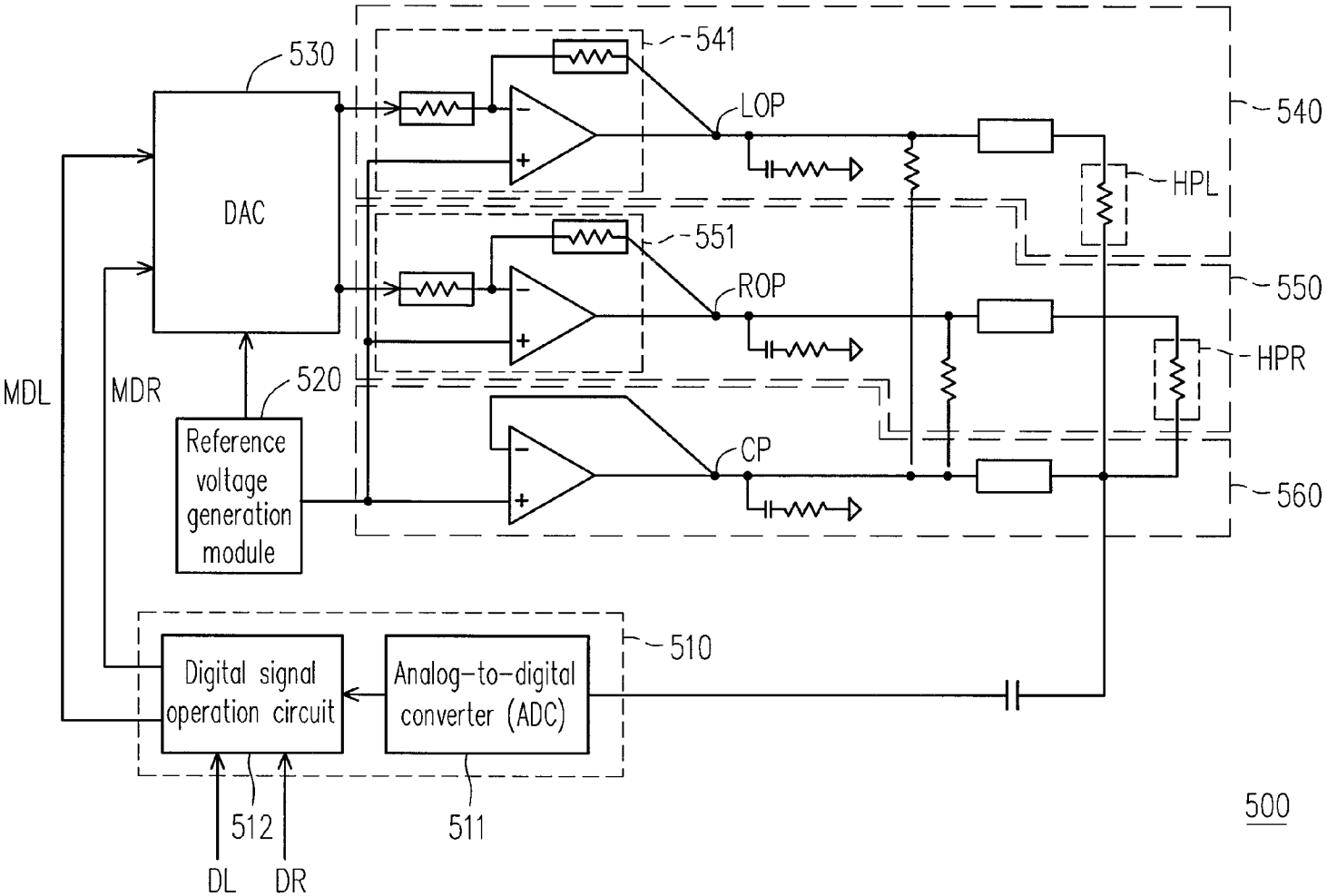
FIG. 5 is a schematic diagram illustrating an audio output apparatus according to another embodiment of the present invention.

Referring to FIG. 5, FIG. 5 is a schematic diagram illustrating an audio output apparatus 500 according to another embodiment of the present invention. The audio output apparatus 500 of the present embodiment includes a digital operation unit 510, a reference voltage generation module 520, a DAC 530, a left channel unit 540, a right channel unit 550 and a common unit 560. A difference between the audio output apparatus 200 of FIG. 2A and the audio output apparatus 500 of FIG. 5 is that a loop is that one end is connected to the digital operation unit 510 and another end point is connected to the left channel earphone unit HPL and the right channel earphone unit HPR. The digital operation unit 510 includes an analog-to-digital converter (ADC) circuit 511 and a digital signal operation circuit 512.

While the audio output apparatus 500 is going to initial status, the digital operation unit 510 starts to transmit a test signal to the DAC 530. The test signal only provides to one-side channel signal. For example, the test signal sends non-silenced signal to left channel and silenced signal to right channel. After the signal passes through the left channel unit 540 and the right channel unit 550, cross talk phenomenon occurs and the ADC circuit 511 in the digital operation unit 510 detects a peak of the cross talk voltage of another side channel from the test signal. In the example above, the peak of the cross talk voltage should be detected in right channel.

Finally, the digital signal operation circuit 512 in the digital operation unit 510 calculates the first and the second ratios x and y according to the peak of the cross talk voltage. When the audio output apparatus 500 goes to decoded status, the digital signal operation circuit 512 applies the first and the second ratios x and y to the digital-format inputted left and right channel signals DL and DR, and then transmits the compensated left channel signal MDL and the compensated right channel signal MDR to the left channel unit 540 and the right channel unit 550 for resisting cross talk situation.

The digital operation unit 510 includes the digital signal operation circuit 512 and the ADC circuit 511. The ADC circuit 511 is coupled to the connection point of the left channel earphone unit HPL and the right channel earphone unit HPR, and is used to receive the cross talk voltage and to obtain the peak of the cross talk voltage. The ADC circuit 511 converts a format of the peak of the cross talk voltage into a digital-format, and transmits it to the digital signal operation circuit 512. The ADC circuit 511 also can be replaced by a peak detecting circuit.

In the initial stage, after the digital signal operation circuit 512 receives the digital format peak of the cross talk voltage, the digital signal operation circuit 512 calculates the first and the second ratios x and y according to the peak of the cross talk voltage. In the case of decoding process, the digital signal operation circuit 512 receives the digital-format left and right channel signals DL and DR and applies them by the first and the second ratios x and y to get the compensated left and right channel signals MDL and MDR for outputting the compensated left and right channel signals MDL and MDR before these send to the DAC 530.

In the present embodiment, the digital operation unit 510 can dynamically detect the cross talk voltage generated by the low-frequency equivalent impedances of the left and the right channel earphone units HPL, HPR, the left and the right channel beads and the common bead. Once these are changed, the test signal will be sent again and the peak of the cross talk voltage will be re-obtained to renew the corresponding first and second ratios x and y.

Figure 6:
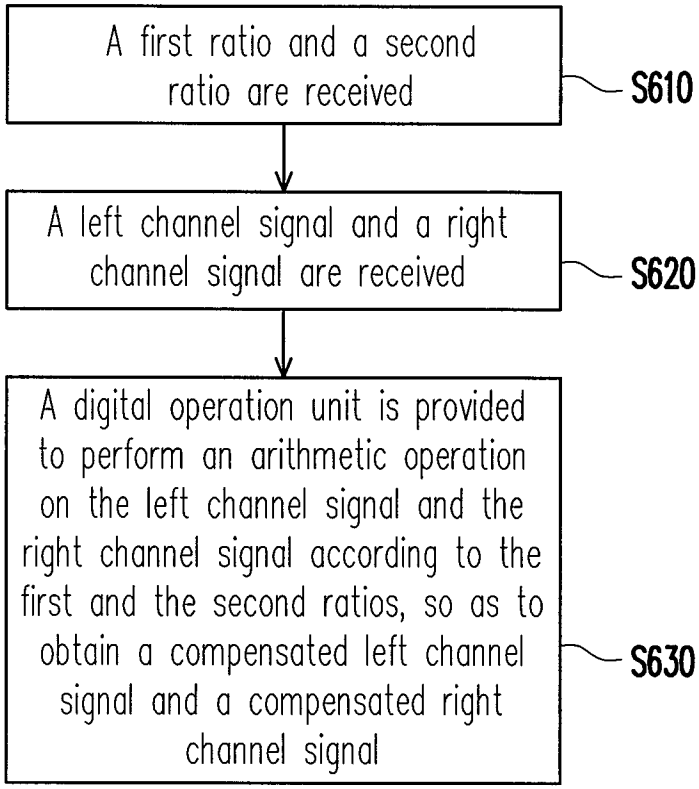
FIG. 6 is a flowchart illustrating a method for compensating an audio output apparatus according to an embodiment of the present invention.

Referring to FIG. 6, FIG. 6 is a flowchart illustrating a method for compensating an audio output apparatus according to an embodiment of the present invention. The method includes following steps. First, a first ratio and a second ratio are received (S610). The first ratio is generated according to impedance values of low-frequency equivalent impedances of a left channel earphone unit, a left channel bead and a common bead, and the second ratio is generated according to impedance values of low-frequency equivalent impedances of a right channel earphone unit, a right channel bead and the common bead. Next, a left channel signal and a right channel signal are inputted into the audio output apparatus (S620). Next, a digital operation unit is provided to perform an arithmetic operation to the left channel signal and the right channel signal according to the first and the second ratios, so as to respectively obtain a compensated left channel signal and a compensated right channel signal (S630).

It should be noticed that the first and the second ratios can be predetermined and stored in a memory, and the ratios will be loaded into the digital operation unit before the audio output apparatus starts to decode. Then, the digital operation unit performs the arithmetic operation on the received left and right channel signals by the first and the second ratios to get the compensated left and right channel signal.

Certainly, the above first and second ratios can also be calculated and stored by the digital operation unit. Before detecting the peak of the cross talk voltage gotten from the left channel earphone unit and the right channel earphone unit, the digital operation unit transmits the test signal to the left channel unit and the right channel unit. Then, before the audio output apparatus starts to playback, the first and the second ratios will be loaded and performed the arithmetic operation. On the other hand, if any earphone is changed, the above steps of transmitting the test signal and detecting the peak of the cross talk voltage need to do again to obtain the updated first and second ratios, and the updated first and second ratios can be stored and provided to the audio output apparatus to reduce the cross talk situation.

Figure 7:
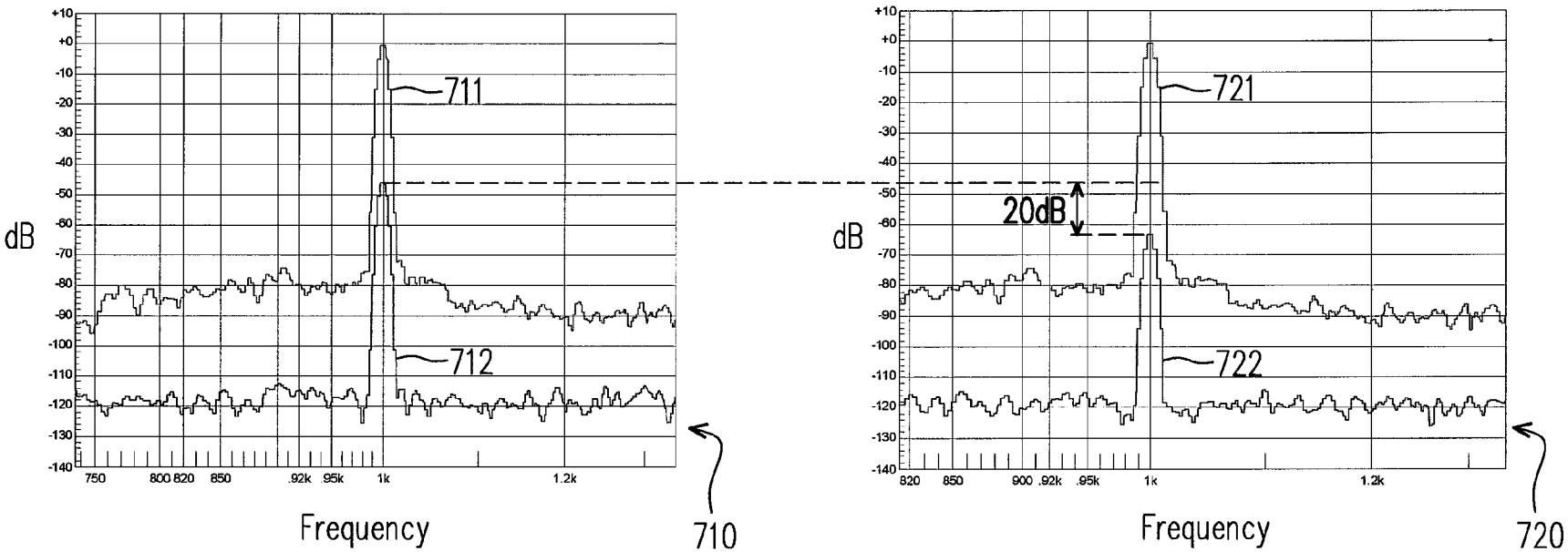
FIG. 7 is a spectrum analysis diagram generated according to an embodiment of the present invention.

Referring to FIG. 7, FIG. 7 is a spectrum analysis diagram which is generated by the embodiment of the present invention. In a spectrum analysis diagram 710 showing the cross talk phenomenon without any compensated operation, a right channel signal spectrum waveform 712 has a significant disturbance due to the cross talk phenomenon generated by a full swing of a left channel signal spectrum waveform 711. Conversely, in a spectrum analysis diagram 720 showing the reduced cross talk phenomenon with the method and the apparatus of the present invention, a disturbance of a right channel signal spectrum waveform 722 generated due to a full swing of a left channel signal spectrum waveform 721 is apparently smaller than the disturbance of the right channel signal spectrum waveform 712 in the spectrum analysis diagram 710 about 20 dB.

In summary, in the present invention, by receiving the first and the second ratios calculated according to the impedance values of the low-frequency equivalent impedances of the left and the right channel earphone units, the left and the right channel beads and the common bead, the digital operation unit in the audio output apparatus can perform the arithmetic operation on the left and the right channel signals according to the first and the second ratios, so as to obtain the compensated left and right channel signals. By such means, no extra hardware circuit needs to be added and the cross talk phenomenon can be eliminated effectively. Therefore, the above method can be achieved to meet cost efficiency and well audio quality.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. An audio output apparatus, comprising:

a digital operation unit, receiving a left channel signal and a right channel signal, performing an arithmetic operation to obtain a compensated left channel signal and a compensated right channel signal respectively;

a digital-to-analog converter (DAC), coupled to the digital operation unit, receiving and converting the compensated left channel signal and the compensated right channel signal to a left channel analog signal and a right channel analog signal;

a left channel unit, coupled to the DAC and the digital operation unit, having a left channel amplifying module, a left channel bead and a left channel earphone unit;

a right channel unit, coupled to the DAC and the digital operation unit, having a right channel amplifying module, a right channel bead and a right channel earphone unit; and a common unit, coupled to the left channel unit and the right channel unit, having a common bead, wherein the digital operation unit performs the arithmetic operation to the left channel signal and the right channel signal according to a first ratio and a second ratio, so as to respectively obtain the compensated left channel signal and the compensated right channel signal, wherein the first ratio is generated according to impedance values of low-frequency equivalent impedances of the left channel earphone unit, the left channel bead and the common bead, and the second ratio is generated according to impedance values of low-frequency equivalent impedances of the right channel earphone unit, the right channel bead and the common bead.

2. The audio output apparatus as claimed in claim 1, wherein the first ratio is greater than 0 and less than twice of a first predetermined value, wherein the first predetermined value is equal to the impedance value of the low-frequency equivalent impedance of the common bead divided by a sum of the impedance values of the low-frequency equivalent impedances of the left channel earphone unit, the left channel bead and the common bead.

3. The audio output apparatus as claimed in claim 1, wherein the second ratio is greater than 0 and less than twice of a second predetermined value, wherein the second predetermined value is equal to the impedance value of the low-frequency equivalent impedance of the common bead divided by a sum of the impedance values of the low-frequency equivalent impedances of the right channel earphone unit, the right channel bead and the common bead.

4. The audio output apparatus as claimed in claim 1, further comprising:

a reference voltage generation module coupled to the DAC for providing a reference voltage; and a common unit amplifying module, coupled to the reference voltage generation module, generating a common voltage according to the reference voltage to transmit the common voltage to the left channel earphone unit and the right channel earphone unit by the common unit.

5. The audio output apparatus as claimed in claim 1, wherein the digital operation unit comprises:

an analog-to-digital converter (ADC) circuit, coupled to a connection point of the left channel earphone unit and the right channel earphone unit, receiving a cross talk voltage to obtain a peak of the cross talk voltage; and a digital signal operation circuit, coupled to the ADC circuit, generating the first and the second ratios according to the peak of the cross talk voltage, and receiving the left and the right channel signals to perform the arithmetic operation on the left and the right channel signals according to the first and the second ratios, so as to respectively obtain the compensated left channel signal and the compensated right channel signal.

6. The audio output apparatus as claimed in claim 1, wherein the digital operation unit further generates a reduced ratio and performs the arithmetic operation on the left and the right channel signals according to the reduced ratio and the first and the second ratios, so as to respectively obtain a reduced compensated left channel signal and a reduced compensated right channel signal.

7. A method for compensating an audio output apparatus, which is used for compensating a cross talk phenomenon generated in the audio output apparatus, the method comprising:

receiving a first ratio and a second ratio, wherein the first ratio is generated according to impedance values of low-frequency equivalent impedances of a left channel earphone unit, a left channel bead and a common bead, and the second ratio is generated according to impedance values of low-frequency equivalent impedances of a right channel earphone unit, a right channel bead and the common bead;

receiving a left channel signal and a right channel signal; and providing a digital operation unit to perform an arithmetic operation on the left channel signal and the right channel signal according to the first and the second ratios, so as to obtain a compensated left channel signal and a compensated right channel signal.

8. The method for compensating the audio output apparatus as claimed in claim 7, wherein the first ratio is greater than 0 and less than twice of a first predetermined value, wherein the first predetermined value is equal to the impedance value of the low-frequency equivalent impedance of the common bead divided by a sum of the impedance values of the low-frequency equivalent impedances of the left channel earphone unit, the left channel bead and the common bead.

9. The method for compensating the audio output apparatus as claimed in claim 7, wherein the second ratio is greater than 0 and less than twice of a second predetermined value, wherein the second predetermined value is equal to the impedance value of the low-frequency equivalent impedance of the common bead divided by a sum of the impedance values of the low-frequency equivalent impedances of the right channel earphone unit, the right channel bead and the common bead.

10. The method for compensating the audio output apparatus as claimed in claim 7, wherein the step of performing the arithmetic operation on the left channel signal and the right channel signal according to the first and the second ratios comprises:

obtaining the compensated left channel signal by the left channel signal adding up a product of the right channel signal and the second ratio; and obtaining the compensated right channel signal by the right channel signal adding up a product of the left channel signal and the first ratio.

11. The method for compensating the audio output apparatus as claimed in claim 7, further comprising:

providing a peak detector to detect a peak of a cross talk voltage on a connection point of the left channel earphone unit and the right channel earphone unit when the digital operation unit transmits a test signal to one of the left channel earphone unit and the right channel earphone unit, and performing a calculation according to the peak of the cross talk voltage to obtain the first ratio and the second ratio.

12. The method for compensating the audio output apparatus as claimed in claim 7, further comprising:

providing the digital operation unit to receive a reduced ratio and to perform the arithmetic operation on the left and the right channel signals according to the reduced ratio, the first ratio and the second ratio, so as to obtain a reduced compensated left channel signal and a reduced compensated right channel signal respectively.

* * * * *